United States Patent [19]

Horten

[11] 4,313,696

[45] Feb. 2, 1982

[54] FRICTION ROCK STABILIZER AND METHOD FOR INSERTION THEREOF IN AN EARTH STRUCTURE BORE

[75] Inventor: Carl R. Horten, Warren, N.J.

[73] Assignee: Ingersoll-Rand Company, Woodcliff Lake, N.J.

[21] Appl. No.: 138,208

[22] Filed: Apr. 7, 1980

[51] Int. Cl.[3] ..... E21D 21/00; E21D 20/00

[52] U.S. Cl. ....., 405/259; 29/451; 403/344; 403/409; 411/479; 411/522

[58] Field of Search ..... 405/259, 260, 261; 29/446, 448, 449, 451, 453, 229, 223, 235; 138/97; 85/85, 8.3, 8.1; 285/370, 397, 214, 421; 403/344, DIG. 7, 374, 409

[56] References Cited

U.S. PATENT DOCUMENTS

| | | | |
|---|---|---|---|
| Re. 30,256 | 4/1980 | Scott | 405/259 |
| 719,817 | 2/1903 | Kunze | 29/453 |
| 2,177,231 | 10/1939 | Tinnerman | 29/229 X |
| 2,180,271 | 11/1939 | Arras | 29/229 X |
| 3,425,757 | 2/1969 | Minor | 403/344 X |
| 3,701,555 | 10/1972 | Harris | 403/409 X |
| 4,109,684 | 8/1978 | Fernandez | 29/451 X |
| 4,142,704 | 3/1979 | Murray | 85/8.3 X |

FOREIGN PATENT DOCUMENTS

| | | | |
|---|---|---|---|
| 2842722 | 4/1979 | Fed. Rep. of Germany | 405/259 |

*Primary Examiner*—Dennis L. Taylor
*Attorney, Agent, or Firm*—Bernard J. Murphy

[57] ABSTRACT

The stabilizer, in a preferred embodiment thereof, comprises a generally tubular body which is axially slit, as in the prior art. According to one practice of the invention, the surfaces of the body immediately adjacent to the slit have ribs formed thereon which define bearing surfaces for clamping together, to draw the surfaces into proximity, narrowing the slit, thereby to contract the stabilizer to a constrained dimension approximately eight percent smaller than its free dimension. This is done to facilitate its insertion into an undersized bore. The novel method, then, in an embodiment thereof, comprises contracting an axially slit friction rock stabilizer by engaging the aforesaid ribs (formed thereon) with a tool, to contract the stabilizer to a reduced and constrained, approximately eight percent smaller, cross-sectional dimension, inserting the stabilizer into an undersized bore, and withdrawing the tool.

5 Claims, 7 Drawing Figures

FRICTION ROCK STABILIZER AND METHOD FOR INSERTION THEREOF IN AN EARTH STRUCTURE BORE

This invention pertains to friction rock stabilizers, and methods for insertion of such in earth structure bores, and particularly to an improved friction rock stabilizer so configured as to facilitate its contraction to render its insertion into an undersized earth structure bore more facile, and to a method for insertion of friction rock stabilizers into undersized earth structure bores.

Friction rock stabilizers are relatively new earth structure stabilizing devices, and such are best exemplified by U.S. Pat. No. 3,922,867, issued Dec. 2, 1975, and U.S. Pat. No. 4,012,913, issued Mar. 22, 1977, both granted to James J. Scott.

According to the teachings in the referenced Patents, friction rock stabilizers comprise generally tubular bodies which may be axially slit, and which have a free cross-sectional dimension predetermined to be larger than the transverse dimension of the earth structure bores into which they are to be inserted. Accordingly, it requires considerable thrusting force to insert such a stabilizer into an undersized bore. During forced insertion, the stabilizer must contract, to negotiate the undersized bore, whereby the slit is substantially closed (during insertion) and, after insertion, the stabilizer attempts to return to its original free dimension; thus it frictionally holds fast to the wall of the bore and, consequently, stabilizes the earth structure.

By way of example, a typical stabilizer has a free greatest, transverse dimension of approximately 1.53-inches (38.86 mm.) and is forceably inserted into a borehole having a diameter of approximately 1.41-inches (35.81 mm.). Patently, it would take no thrust force to install such a stabilizer in such a borehole if the former were contracted, radially, to a dimension of less than the borehole diameter. Then such a contracted stabilizer could be manually inserted into the borehole with virtually little effort (following which the radially-contracting restraint could be released to allow the stabilizer to engage the bore wall). However, in order for the friction rock stabilizer to be a viable and economically-practical article, it must be formed of relatively inexpensive low-carbon steel or the like. Consequently, such inexpensive-materials stabilizers lack sufficient resilience to function as aforesaid. If such stabilizers are contracted to less than the borehole diameter, they lack the resilient spring-back force efficiently to engage the borehole wall (and stabilize the earth structure). High-carbon-steel stabilizers can be made to function thus but, of course, the cost thereof would be prohibitive.

It is an object of this invention, then, to set forth a friction rock stabilizer which can be forceably inserted into an undersized earth structure bore with an insertion force significantly less than that required in prior art practice. Too, it is an object of this invention to disclose a method for inserting a friction rock stabilizer into an undersized bore with such significantly less insertion force. Accordingly, it is an object of this invention to disclose both a friction rock stabilizer having means formed thereon to facilitate a limited, pre-insertion contraction thereof for installation in an undersized bore, and also a method comprising the steps of limited, pre-insertion contraction and insertion of friction rock stabilizers.

Particularly, it is an object of this invention to set forth a friction rock stabilizer for insertion in a bore of a given diameter formed in an earth structure for stabilizing the structure, comprising a generally tubular body; said body having an elongate axis and wall means for frictionally engaging the surface of an earth structure bore of such given diameter; said body further having a first, free, relaxed, transverse dimension predetermined to be larger than the given diameter of a bore into which it is to be inserted; said wall means having a generally axially-extended means formed therein permitting contraction of said body from a first, relaxed, greatest transverse dimension thereof to a second, smaller, constrained transverse dimension; and means engaging a surface of said body constraining said body in contraction in said second dimension; wherein said second dimension is substantially equal to the diameter of the bore into which the stabilizer is to be inserted.

It is also a further object of this invention to teach a method of inserting a radially-contractible friction rock stabilizer, having a given, free, greatest transverse dimension, into an earth borehole having a diameter of less than said given dimension, comprising the steps of radially contracting the stabilizer to a prescribed, transverse dimension which is substantially equal to the borehole diameter; and forceably inserting the contracted stabilizer into the borehole.

Further objects of the invention, as well as the novel features thereof, will become more apparent by reference to the following description, taken in conjunction with the accompanying figures in which.

Figure 1:
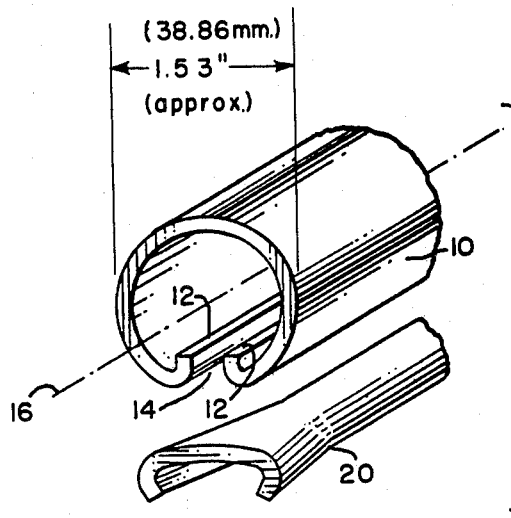
FIG. 1 is an isometric projection of an end portion of a friction rock stabilizer, according to an embodiment of the invention, and a clamping device for use therewith.
Figure 2:
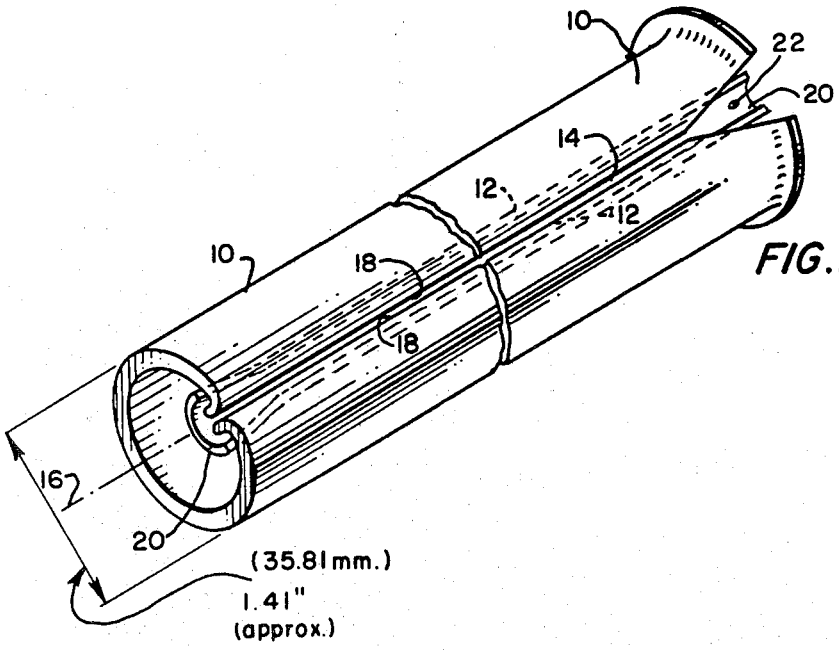
FIG. 2 is a discontinuous isometric projection of the stabilizer and clamping device of FIG. 1 shown in operative, engaged relationship.

According to the referenced U.S. Pat. No. 3,922,867, an embodiment of a friction rock stabilizer may have an axially-extended slit formed therein. Such a stabilizer 10 is shown in FIGS. 1 and 2 and, according to this inventive embodiment, has the edges 12 of the slit 14 thereof turned inward generally toward the central axis 16 thereof. Stabilizer 10 is defined with a free, greatest outside dimension of approximately 1.53-inches (38.86 mm.). According to the invention, the stabilizer 10 is forceably contracted to an outside dimension which substantially corresponds to the diameter of the borehole in which it is to be inserted; i.e., in this embodiment, the stabilizer is contracted to approximately 1.41-inches (35.81 mm.). This moves the confronting surfaces 18 thereof toward each other, and dispose the edges 12 as bearing surfaces or keys slidably to receive a clamping device 20. The device 20, of substantially U-shaped cross-section, has a flared or widened end 21 which has a width sufficient to straddle and slidably engage the edges 12 at one end of the stabilizer. Then, the device 20 is forced along the stabilizer 10, axially, to hold the surfaces 18, in proximity, as aforesaid. The stabilizer 10, then, being substantially closed along the slit 14, the edges 12 lie as closely-coupled, parallel strips or ribs. The device 20, slidably and axially engaged with the edges 12, functions as keyway to hold the "key" edges 12 in close coupling and, resultingly, the stabilizer 10 in contracted position. Now then, the stabilizer 10, for having a cross-sectional or transverse dimension substantially corresponding to the diameter of the earth structure bore in which it is to be installed, can be forceably inserted therein with approximately a three-ton insertion force. Upon the contracted stabilizer 10 being installed into the bore, the clamping device 20 can be slidably withdrawn. To accommodate for this, the contraction or clamping device 20 has an aperture 22, formed through the lower end, which may be grasped by a tool in order that the tool can pull the device 20 free.

In U.S. Pat. No. 4,012,913, patentee Scott set forth an alternative embodiment of his friction rock stabilizer in which the edges of the slit therein are or may be overlapped.

Figure 4:
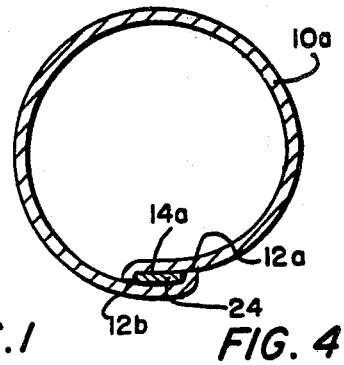
FIG. 4 is a cross-sectional view taken along Section 4—4 of FIG. 3.
Figure 3:
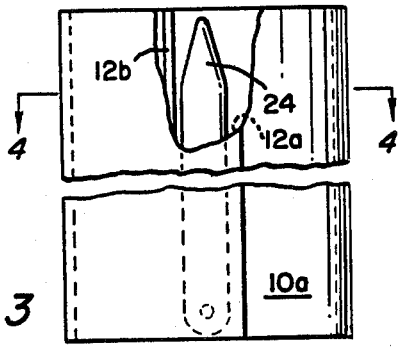
FIG. 3 is a discontinuous, elevational view of an alternative embodiment of a friction rock stabilizer, according to the invention, showing an alternative contracting tool in use therewith.

In FIGS. 3 and 4 I disclose an alternative embodiment 10*a* of a stabilizer according to the invention, drawn on the type of stabilizer depicted in said U.S. Pat. No. 4,012,913. Herein I turn the edges 12*a* and 12*b* of the "overlapped" slit 14*a* in opposite directions so that the edges define parallel and confronting strips or ribs. Then by inserting a spacer blade 24 therebetween, the strip or rib-defining edges 12*a* and 12*b* are forced apart, resulting in a contraction of the stabilizer 10*a* to substantially the diameter of the earth structure bore into which it is to be inserted. Again, following earth structure bore insertion of the thereby contracted stabilizer 10*a*, it remains only to withdraw the blade 24, by means of the tool-aperture 22*a*.

To my attention has come R.S.A. patent specification No. 78/5306 which was published in the R.S.A. *Patent Journal* of August 1979. The R.S.A. publication is alleged to have a filing date priority based on a Swedish patent application No. 7711060-9 of Oct. 3, 1977. The R.S.A. specification recites a method of inserting a "friction roof bolt" in a hole in a roof or side wall of an underground opening for anchoring the roof or side wall, said bolt comprising a generally annular body from end-to-end having a slot through its thickness and being arranged to permit radial compression, wherein a hole is formed in the roof or side wall having a diameter which is smaller than that of said body when the body is in a noncompressed state, characterized by the steps of radially compressing said body to a diameter somewhat smaller than the diameter of the hole, fixing said body in the compressed state, inserting the compressed body in the hole, and causing the body to expand to engage the surrounding wall of the hole upon being inserted in the hole.

The aforesaid R.S.A. specification defines a method not too dissimilar to my inventive method which comprises inserting a radially-contractible friction rock stabilizer having a given, free, greatest transverse dimension into an earth borehole having a diameter of less than said given dimension, comprising the steps of radially contracting the stabilizer to a prescribed transverse dimension which is substantially equal to the borehole diameter, and forceably inserting the contracted stabilizer into the borehole.

The method of the R.S.A. specification and my own differ in at least one, material respect, however. My method comprises contracting the stabilizer to a dimension substantially equal to the borehole diameter, and not any smaller; the method of the aforesaid specification comprises contraction to a dimension somewhat smaller than the borehole. The latter presupposes free, hand insertion; my method presupposes a sliding, frictional interference-fit insertion which may require up to three tons of insertion force.

As noted, excessive contraction of the stabilizer, i.e., to a diameter or transverse dimension somewhat less than the borehole diameter, accommodates a convenient, relatively effortless, free hand insertion, however it will: (a) require a stabilizer formed of prohibitively expensive metal, or (b) result in the standard, inexpensive materials stabilizer exhibiting insufficient resilient springback to insure stabilizer engagement with the bore wall with a reliable, stabilizing frictional engagement.

The embodiments of FIGS. 1–4 comprise, by way of example, stabilizers 10 and 10*a* which, as priorly noted, have a free, greatest transverse dimension of approximately 1.53-inches (38.86 mm.), and which are predetermined to be forceably inserted into an earth structure borehole of approximately 1.41-inches (35.81 mm.) in diameter. The insertion thereof can be effected with only a three-ton thrust force, and such force is available from conventional, state-of-the-art roof bolter apparatus. The device 20 and blade 24 are so dimensioned as to restrain the stabilizers 10 and 10*a* contracted to substantially the aforesaid borehole diameters. The contraction of the stabilizers 10 and 10*a*, then, reduces the transverse dimension thereof to one which is approximately eight percent smaller than the aforesaid free dimension thereof.

Figure 5:
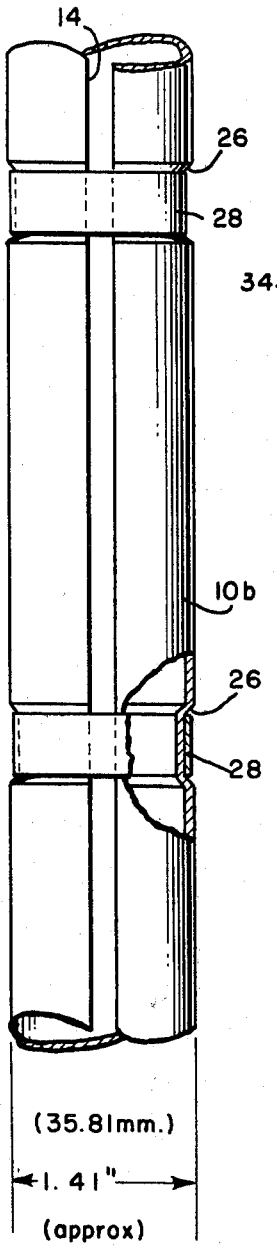
FIG. 5 is an elevational view of an intermediate portion of yet another alternative embodiment of a stabilizer, according to the invention, showing contraction bands thereabout.
Figure 7:
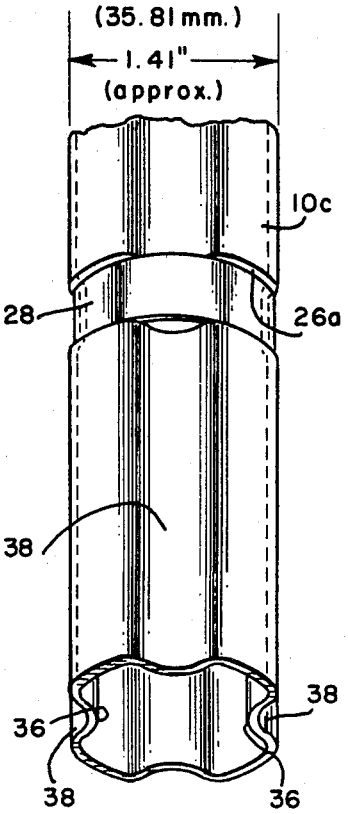
FIG. 7 is an isometric projection of a portion of a further alternative embodiment of the novel stabilizer.

A more facile means of holding the stabilizers to any selected contraction is depicted in FIGS. 5 and 7.

Figure 6:
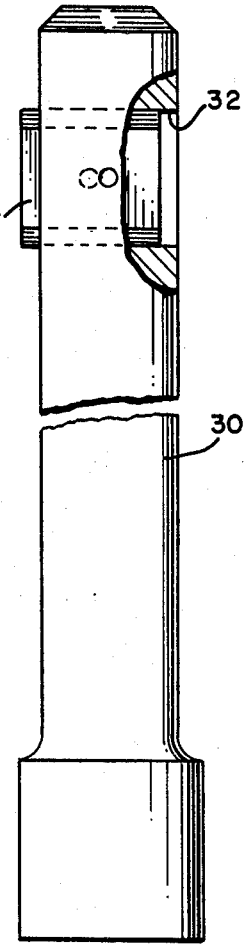
FIG. 6 is a discontinuous elevational view of a band-cutting tool for use with the embodiment of FIG. 5.

FIG. 5 illustrates an intermediate portion of stabilizer 10*b* which has annular, relieved lands 26 formed therein. The stabilizer is contracted to 1.41-inches (35.81 mm.) in diameter and is held thereto by enwrapped fiberglass bands 28. In that the lands 26 are relieved, the bands are nested therein and are set back or recessed from the nominal surface of the stabilizer 10*b*. Accordingly, the bands 28 are shielded from the borewall, during stabiliser insertion, and will not be abraded and opened. The bands 28, then, are slit following stabilizer insertion. To this end, the tool 30 of FIG. 6 is disclosed. Tool 30 has a cutter-blade slot 32 formed therein in which, with appropriate hardware, to fix a projecting band-cutter blade 34. The tool 30 is inserted into the borehole-installed stabilizer 10*b*, with the blade 34 oriented to traverse along the slot 14 of the stabilizer. Upon encountering the bands 28, the blade 34 cuts them open, and the stabilizer 10*b* is free to expand to its greatest possible dimension.

The teachings of this disclosure pertain to friction rock stabilizers which comprise a continuous wall, such as stabilizer 10*c* of FIG. 7. Stabilizer 10*c* has inwardly-directed and axially extending ribs 36 which: (a) add peripheral material to the stabilizer, (b) render the body responsive to radial contraction, and (c) define axial stiffening members, to facilitate thrusted insertion. Here too, relieved lands 26*a* have nested bands 28 (only one being shown) which hold the stabilizer 10*c* in a contracted 1.41-inches (35.81 mm.) dimension—for insertion into a borehole of approximately 1.41-inches (35.81 mm.). Again, the bands 28 are severed, following insertion of the stabilizer 10*c*, by sliding a blade-carrying tool (like tool 30) along one of the troughs 38 defined by the ribs 36.

While I have described my invention in connection with specific embodiments thereof, and methods of practice, it is to be clearly understood that this is done only by way of example, and not as a limitation to the scope of my invention as set forth in the objects thereof and in the appended claims.

I claim:

1. A method of inserting a radially-contractible, friction rock stabilizer, having a given, relaxed, greatest transverse dimension, into an earth borehole having a diameter of less than said given dimension, for stabilizing the earth, comprising the steps of:

radially contracting the stabilizer to a prescribed transverse dimension which is substantially equal to the borehole diameter; and forceably inserting the contracted stabilizer into the borehole; and further including the steps of forming said stabilizer with at least one, substantially annular, relieved land, in the outer surface thereof, which land has a given depth; and fixing a restraining band in said land, to retain said stabilizer in said prescribed dimension, prior to said inserting step; wherein said fixing step comprises fixing a band, in said land, which has a thickness of less than said given depth, whereby said band will avoid contact with any surface of the borehole during borehole insertion of the stabilizer.

2. A friction rock stabilizer, for insertion in a bore of a given diameter formed in an earth structure for stabilizing the structure, comprising:

a generally tubular body;

said body having an elongate axis, and wall means for frictionally engaging the surface of an earth structure bore of such given diameter;

said body further having a first, relaxed, greatest transverse dimension predetermined to be larger than a given diameter of an earth structure bore into which it is to be inserted;

said wall means having a generally axially-extended means formed therein permitting contraction of said body to a second, constrained, transverse dimension which is substantially equal to the given diameter of the bore into which the stabilizer is to be inserted;

at least one substantially annular, relieved land formed in said wall means for nesting therewithin band means for constraining said body in contraction in said second dimension;

said land having a given depth; and a restraining band fixed in said land, constraining said body in contraction in said second dimension; wherein said band has a thickness of less than said given depth, whereby said band will avoid contact with any surface of the bore into which the stabilizer is to be inserted.

3. A friction rock stabilizer, according to claim 2, wherein:

said body further has an elongate channel formed therein which extends transverse to said land;

said channel defines a recess beneath said band; and said band bridges across said recess.

4. A method of inserting a friction rock stabilizer into a bore formed in an earth structure, for stabilizing the structure, said stabilizer comprising a generally tubular body; said body having an elongate, central axis, and wall means for frictionally engaging the surface of an earth structure bore; said body further having a first, free, relaxed, transverse dimension predetermined to be larger than the transverse dimension of a bore into which it is to be inserted, and an axial length which is considerably greater than said transverse dimensions; and said body also having an axially-extended relief formed in said wall means thereof to permit said body to assume a second, constrained, transverse dimension which is substantially equal to said transverse dimension of a bore into which it is to be inserted; wherein said wall means has confronting axially-extended and spaced-apart surfaces which define said relief therebetween, and axially-extended, substantially parallel strips for: (a) receiving stabilizer-contracting forces thereat, and (b) responsive to such forces, for moving said strips relative to each other to cause contraction of said stabilizer; wherein said strips lie substantially radially, relative to said elongate axis, and extend along a substantial length of said body; and at least one of said strips projects inwardly, from said wall means, toward said axis of said body; said inserting method comprising the steps of:

slidably engaging the strips with a device to cause relative movement therebetween, and a resulting contraction of the stabilizer to said second, constrained transverse dimension;

inserting the contracted stabilizer into the bore; and disengaging the device to permit a release of the stabilizer from its contracted constraint.

5. A method, according to claim 4, wherein:

said contracting step comprises reducing the stabilizer to prescribed dimension which is approximately eight percent smaller its given, relaxed dimension.

* * * * *